US006334225B1

(12) United States Patent
Brinkmann

(10) Patent No.: US 6,334,225 B1
(45) Date of Patent: Jan. 1, 2002

(54) MOVEABLE SHOWER SEAT

(76) Inventor: Gary Brinkmann, 1686 St. Barbara Street, Ottawa (CA), K1T 1L9

( * ) Notice: Subject to any disclaimer, the term of this patent is extended or adjusted under 35 U.S.C. 154(b) by 0 days.

(21) Appl. No.: 09/618,727

(22) Filed: Jul. 18, 2000

(51) Int. Cl.[7] ..... A47K 3/02
(52) U.S. Cl. ..... 4/560.1; 4/578.1
(58) Field of Search ..... 4/560.1, 571.1, 4/578.1, 579, 254

(56) References Cited

U.S. PATENT DOCUMENTS 4,253,203 A * 3/1981 Thomas ..... 4/560.1
5,373,591 A * 12/1994 Myers ..... 4/560.1
5,558,022 A * 9/1996 Manson et al. ..... 4/560.1
6,182,304 B1 * 2/2001 Freeberg ..... 4/560.1

* cited by examiner

*Primary Examiner*—Gregory L. Huson
*Assistant Examiner*—Tuan Nguyen
(74) *Attorney, Agent, or Firm*—David J. French

(57) ABSTRACT

A displaceable seat is carried by support bars with outer support legs. The inner ends of the bars rest through rollers on rails extending across a bathtub. The outer support legs extend downwards to terminate in casters which rest on the bathroom floor and preferably have a brake member. A person may be readily moved from outside the tub into the interior for showering by advancement of the support bars and seat along the rails, and shifting the outer support legs towards the outside wall of the bathtub in an "accordion-like" manner.

20 Claims, 6 Drawing Sheets

BOTTOM VIEW

MOVEABLE SHOWER SEAT

FIELD OF THE INVENTION

This invention relates to a seat for introducing invalids into a shower. More particularly it provides a displaceable seat that will permit an individual to be shifted from a seated position outside a combination bath-shower to an inner position where showering can occur.

BACKGROUND TO THE INVENTION

The bathing of persons who are essentially unable to walk or support their bodies for entry into a shower stall creates problems for health care personnel. Particularly in homes, combination bath-shower units provide a barrier in the form of the bathtub wall over which the invalid must pass in order to be showered.

Various sliding seat systems have been proposed to aid in this process, avoiding exposure of the health care professional to physical strain. These include U.S. Pat. Nos. 5,940,905; 5,822,809; 5,373,591; 4,359,791; 4,253,203 and 4,168,549. All of these systems, with the exception of patent 5,373,591 provide for the protrusion of seat support structures into the interior of the bathroom adjacent a tub with no option of reduction in size.

The need for a bathtub chair capable of moving an patient from the outside of a bathtub into the bathtub enclosure to have a shower/bath is due to the undesirability of requiring the caregiver to move the patient to the center location of the bathtub by stepping into the bathtub. Stepping into the bathtub or even bracing a foot onto the far ledge to lift a patient can be dangerous to both the patient and the caregiver. For this reason some caregiver employers are discontinuing bath services and supplying only a sponge bath for persons who are under their daily personal care.

In many prior art systems a seat is provided with bearings, e.g. rollers or sliders, that allow the seat to be shifted over a bathtub sidewall along tracks or rails. The tracks have, in the past, been supported by legs that extend to the floor of the bathtub on one side, and to the floor of the room exterior to the bathtub on the other side. While these systems may have been effective within their limitations, a need still exists for a displaceable bathing chair positioning system that will permit, without exposing the health care worker to risk, the appropriate transfer of a patient from the outside to the inside of a tub for showering. This should operate without occupying valuable bathroom floor space when not in use. This invention addresses such need.

It would be particularly desirable to provide a bathtub chair system that will supply the following:

- reduces in size to almost the width of the bathtub when in the bathing position or when not in use
- is adaptable to more than 90% of all bathtubs on the market due to dimensions
- maintains a constant height regardless of the height of the bathtub for easy transfer
- allows a caregiver to place their feet under the chair to lift the a person for improved transfer mechanics
- provides sturdiness by which the base of the chair is locked/wedged into position
- has a structure which is light enough to be removed for others to use the bathtub.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

A seat is mounted to roll on rails from a position outboard the side of a bathtub to a location over the center of a bathtub where a person may be washed or showered. Two rails span the width of the bathtub. Such rails are supported on the inner side by inner rail-support means such as legs extending to the bathtub floor, a bathroom wall attachment and/or through spacers extending to the inner ledge of the bathtub. These rails are further supported on the outerside by outer rail-support means preferably in the form of two fixed rail-support legs that extend to the floor adjacent the exterior wall of the tub. Optionally, the exterior support may also extend to the outer bathtub ledge or wall.

The seat is itself mounted on two transverse, seat supporting bars, held off the floor on the side of the seat remote from the bathtub by two moveable seat-support legs. Thus, preferably, four legs are present in the bathroom outside of the bathtub. The other ends of the seat supporting bars carry respective seat-support bearings, e.g. rollers shaped and positioned to engage with the two rails. The exterior ends of the seat supporting bars, opposite to the bearings are preferably free to be elevated while the bearings continue to rest on the rails. Preferably such elevation occurs with the bearings being located at the axis of rotation, allowing the seat to be more readily advanced in a wheelbarrow-like fashion with reduced risk of galling or jamming.

By advancing the supporting bars inwardly, allowing the seat-support bearings (e.g. rollers) to advance along the rails, the seat may be shifted from a location outside of the bathtub to a location centered over the bathtub. To facilitate this motion, the moveable legs may be provided with casters. These casters may be fitted with one or more locks preferably actuatable, e.g. through linkages, by a person assisting the invalid, or by a person positioned on the seat.

Braces may stiffen the rails, the support bars and the respective pairs of legs. The seat may be provided with arm rests and a back rest.

To ensure that the rails are not displaced during use, a positioning brace may extend downwardly from the rails to engage with the inside surface of the bathtub wall.

By employing rail-support legs to support the rails, the assembly may be made independent of the height of the bathtub outer sidewalls. Where the inner side of the tub has an inner sidewall of appropriate height, the rails may alternately rest on the top ledge surface provided by the inner sidewall. This arrangement dispenses with the need for support legs to extend downwardly from the rails within the tub. To accommodate inner ledges of differing heights, the inner ends of the rails may be provided with adjustable spacers that extend downwardly to rest on the inner ledge.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
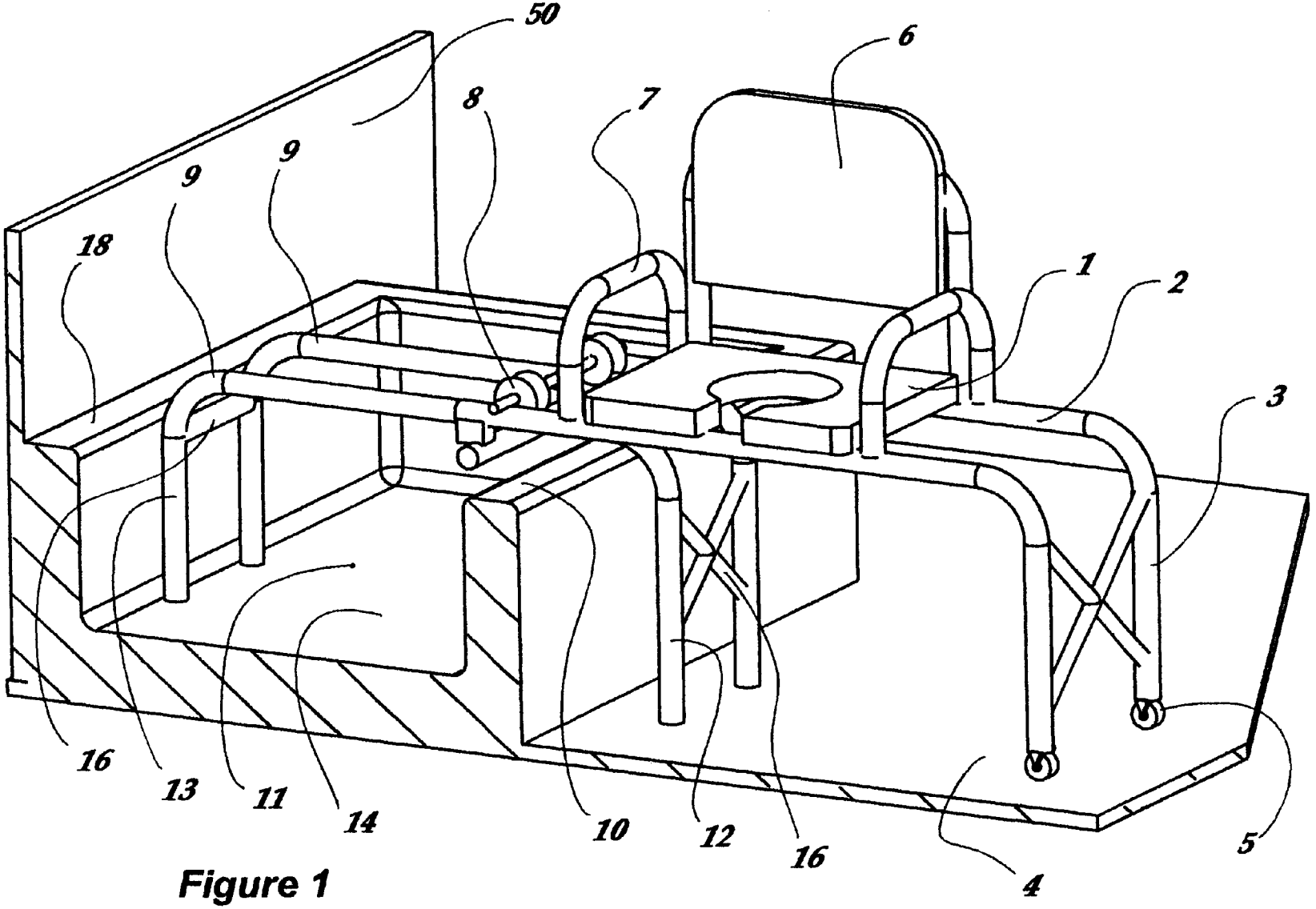
FIG. 1 is a perspective view of the seat assembly of the invention utilizing inner rail-support legs positioned adjacent to a tub-shower with the seat located outboard of the bathtub wall.

In FIG. 1 a seat 1 rests on support bars 2 that have moveable seat-support legs 3 that extend to the floor 4. Optional casters 5 may be used for floor contact. The seat preferable has a back rest 6 and may have arm rests 7.

The seat assembly is intended to be fitted to a typical bathtub, ranging preferably with a width of up to about 34 inches and having a bathtub wall 10 of about 14 to 19 inches in height. Additionally, in one variant, it is desirable that the bathtub have an inner wall and upper ledge 18 of about two inches in width.

At the inner ends of the support bars, bearins in the form of rollers 8 engage a pair of rails 9 that traverse the bathtub wall 10, and extend across the inner bathtub region 11. Outer rail support legs 12 extend to the room floor 4 at the outer ends of the rails 9. In one variant inner legs 13 support the inner ends of the rails 9 by extending to the floor 14 of the bathtub. First transverse braces 25 stiffen the rails 9 along their length, and second transverse braces 16 extend between the seat and rail support between legs 3, 12, 13. The rails 9 may extend beyond the inner legs 13 towards the room wall.

The rollers 8 are preferably grooved to embrace the rails 9, but other known bearing and rack-engagement systems such as low-friction sliding blocks may be employed. These rollers 8 provide a low-friction contact that permits them and the support bars 2 to be readily advanced along the rails 9.

Figure 2:
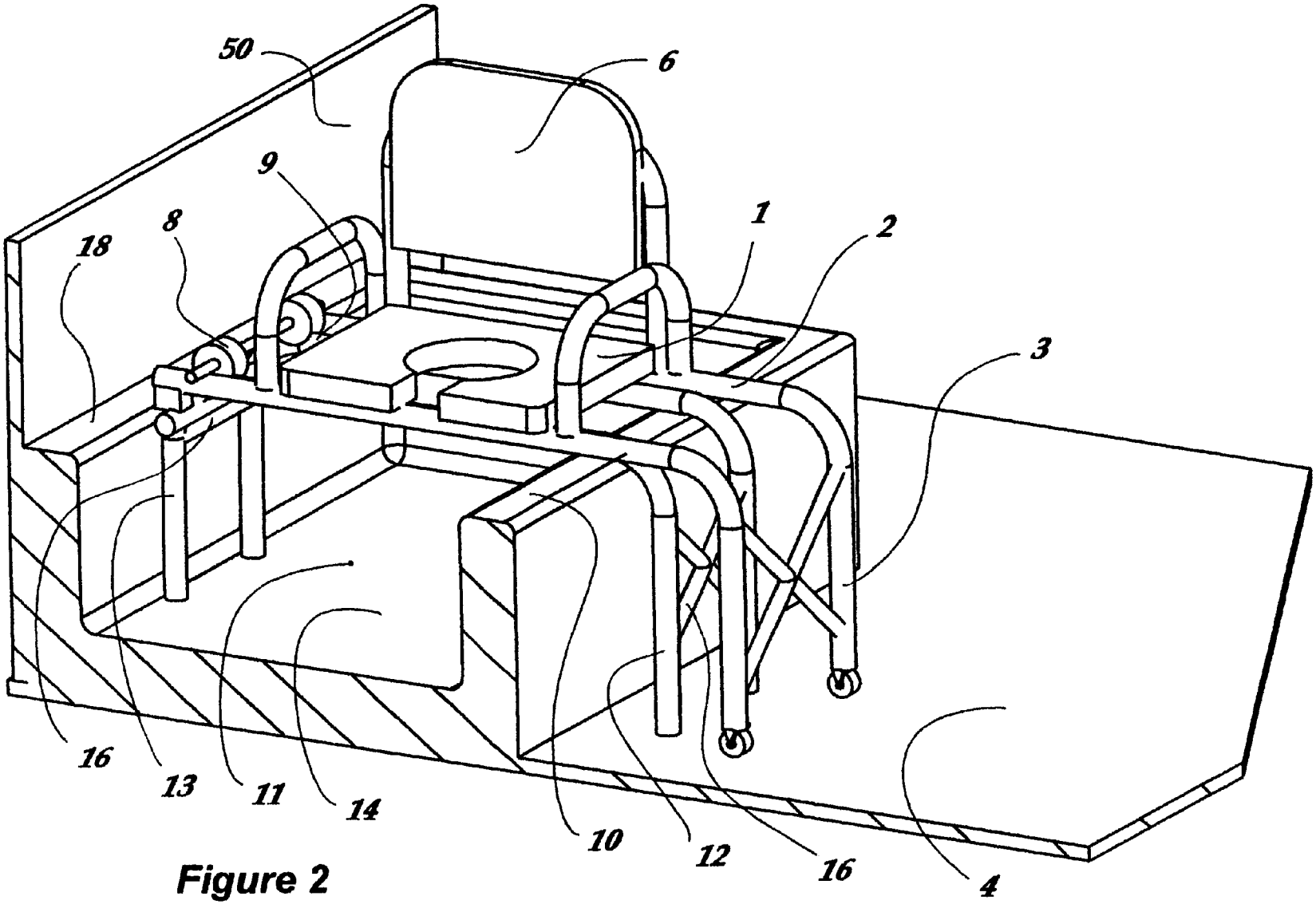
FIG. 2 is the view of FIG. 1 with the seat displaced inwardly to be located over the bathtub, in the shower area.

In FIG. 2 the seat 1, has been advanced into the inner bathtub region 11. The seat-support legs 3 have closed-up to the rail support legs 12. In this view second transverse braces 16 between the seat-support legs 3 may be seen.

Figure 3:
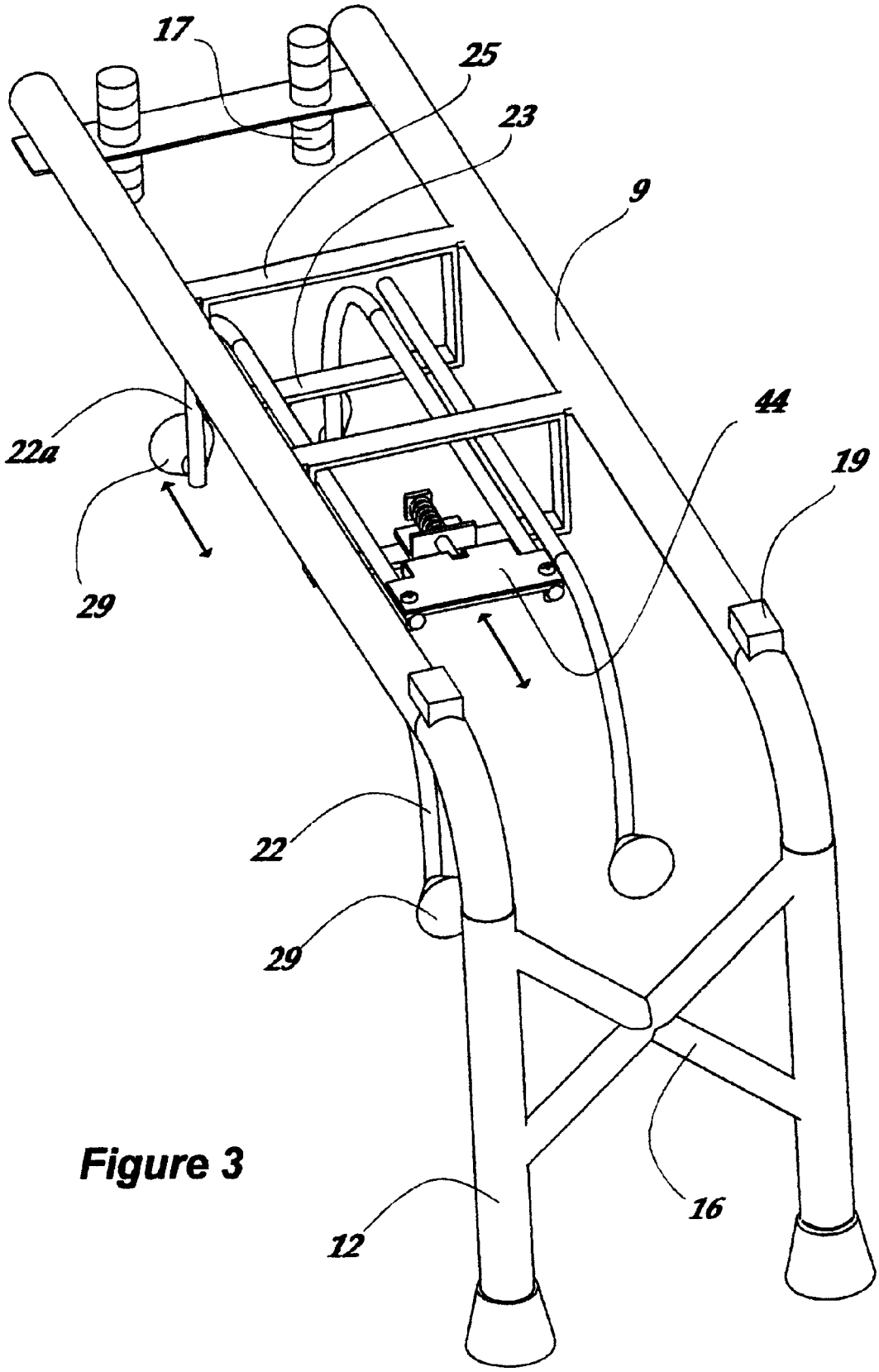
FIG. 3 is a perspective view of the rail assembly for carrying the support bars and seat of FIG. 1 with ledge-support brackets in place of inner rail-support legs.
Figure 5:
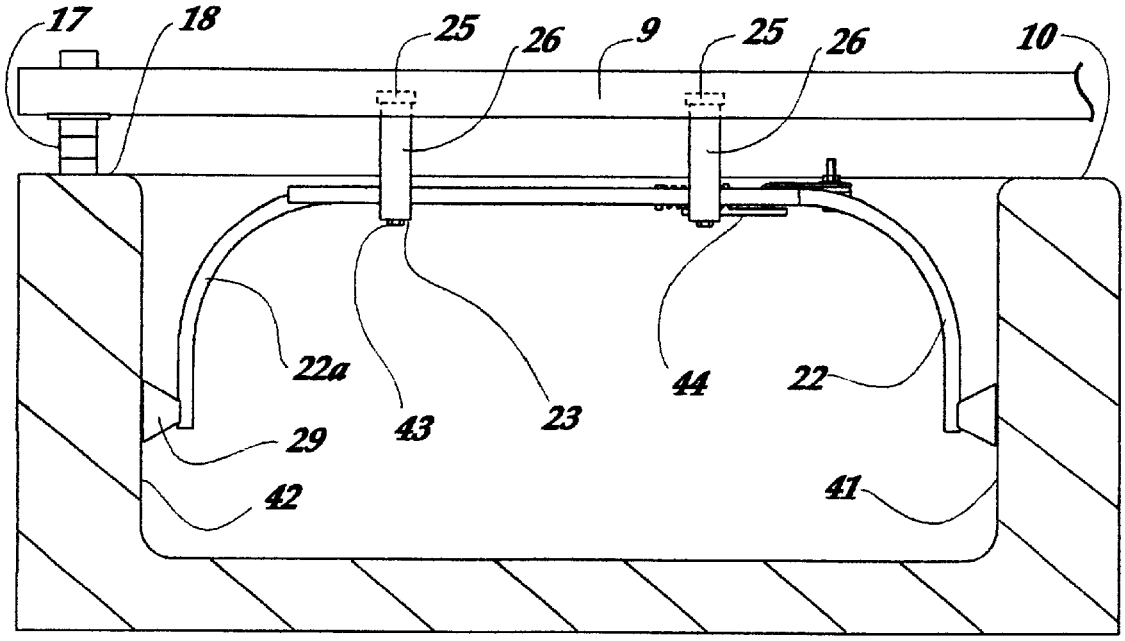
FIG. 5 is a cross-section of a bathtub with the rail assembly of the invention installed in place, including adjustable brackets engaging the inner bathtub ledge and a locking draw hasp to lock the assembly in place.

In FIG. 3 a variant on the rail assembly of FIG. 1 is shown wherein the inner legs 13 are substituted by support spacers 17 of adjustable height. These support brackets 17 serve as struts and extend to the inner ledge 18 of the tub, adjacent the room wall 50, as shown in FIGS. 1 and 5. The spacers 17 at the inner ends of the rails 9, serve as struts may conveniently be formed by placing a series of thick washers along a bolt, locating such washers above or below the rails 9 to adjust the height of the inner ends of the rails 9.

As a further alternative a fitting (not shown) may be attached to the bathroom wall to serve as part of an inner rail support means. The rails 9 may then be connected to this fitting to provide a support for the rails 9 at their inner ends.

In FIG. 3, travel stops 19 are fitted to the rails 9 to limit travel of the seat 1 (not shown). As well, dual pairs of adjustable positioning brackets 22, 22*a* in the form of tubing terminating in cushion means such as rubber feet 29 underlie the rails 9. These rubber feet 29 bear against the inner sides 41, 42 of the tub to secure the rails 9 in place. This feature is also shown in greater detail in FIG. 5.

Figure 4:
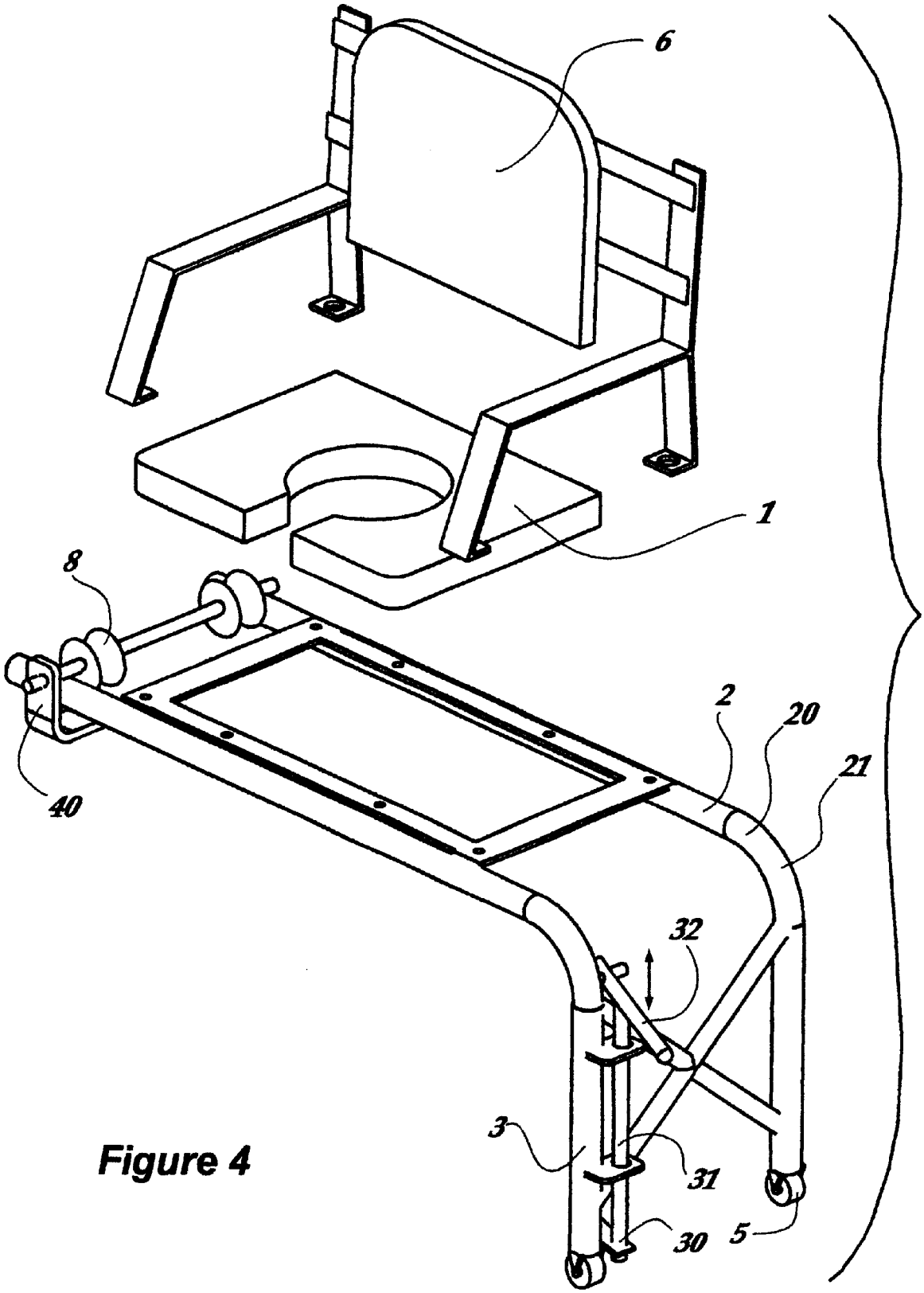
FIG. 4 is an exploded perspective view of the support bars and seat assembly of FIG. 1.

In FIG. 4 the support bars 2 and seat assembly of FIG. 1 are depicted. The outer ends 20 of the support bars 2 extend outwardly beyond the seat 1 and provide, at the curved bend 21 convenient grasping surfaces for elevating the outer ends 20 of the support bars 2. This ensures that the casters 5 can be cleared over surface irregularities in the floor 4, if any exist.

Figure 8:
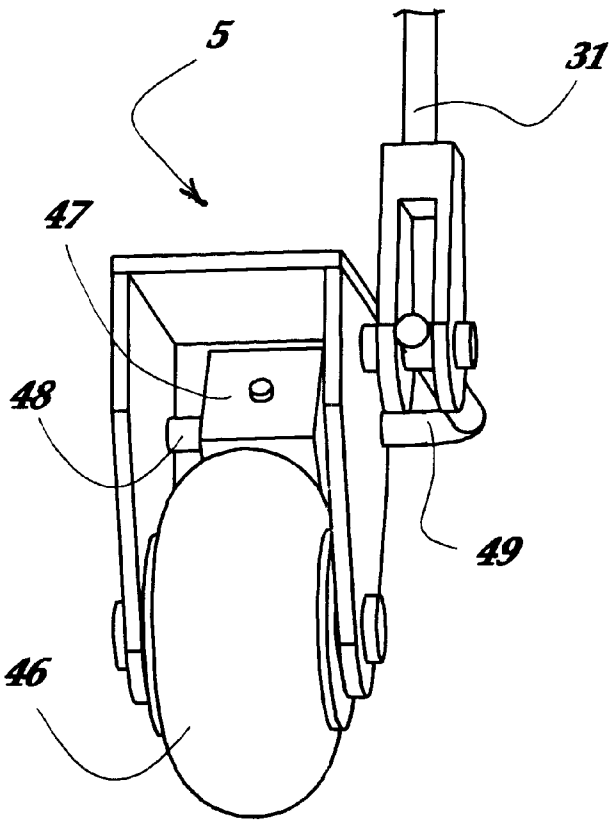
FIG. 8 is an oblique end view of the caster of FIG. 7.
Figure 7:
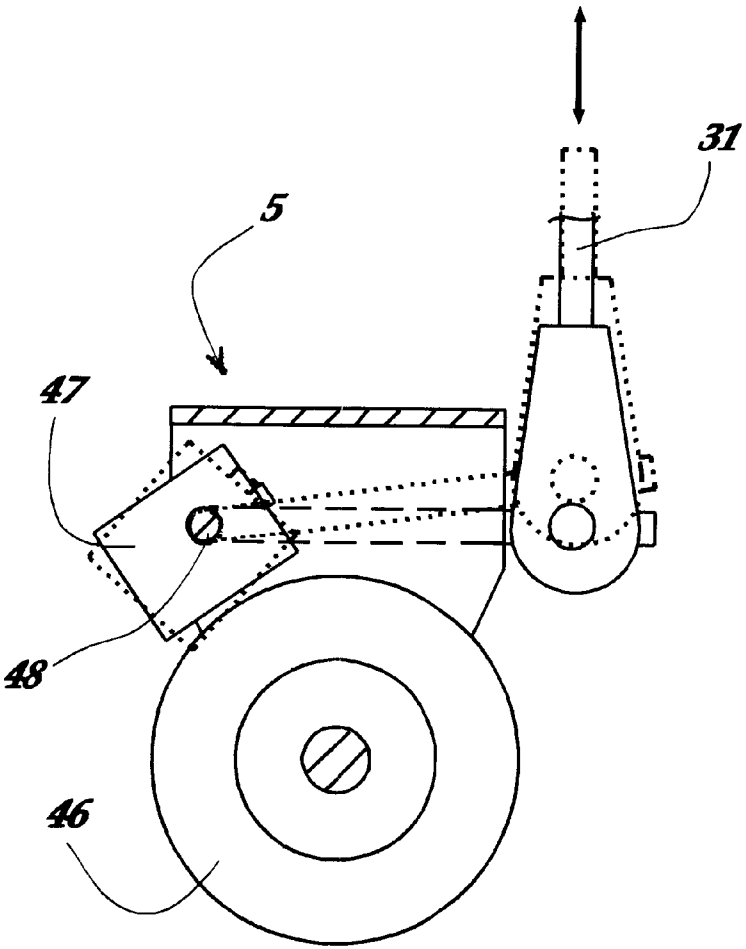
FIG. 7 is a side view of a caster for the seat support legs.

The casters 5 are optionally provided with a brake mechanism 30 (shown in greater detail in FIGS. 7 and 8). A linkage in the form of a rod 31 extends upwardly from the brake mechanism 30 along side the seat support legs 3 to a hinged handle 32 that causes the rod 31 to shift longitudinally.

In FIG. 5, the spacers 17 are shown in place, bearing against the bathtub inner ledge 18 to establish height of the rails 9.

The rails 9 are also stabilized by the tubular braces 22, 22*a* that are carried by lower transverse plates 23 extending between the rails 9. Upper plates 25 also spanning between the rails 9 to stiffen them may be mid-way mounted on the rails 9 to allow the rollers 8 to pass unhindered along the rails 9. The lower transverse plates 23 may hang from the upper plates 25 by end plates 26 to provide clearance for a half shackle 40 that extends down below the rollers 8 as a safety feature to ensure that the rollers 8 do not disengage from the rails 9.

Figure 6:
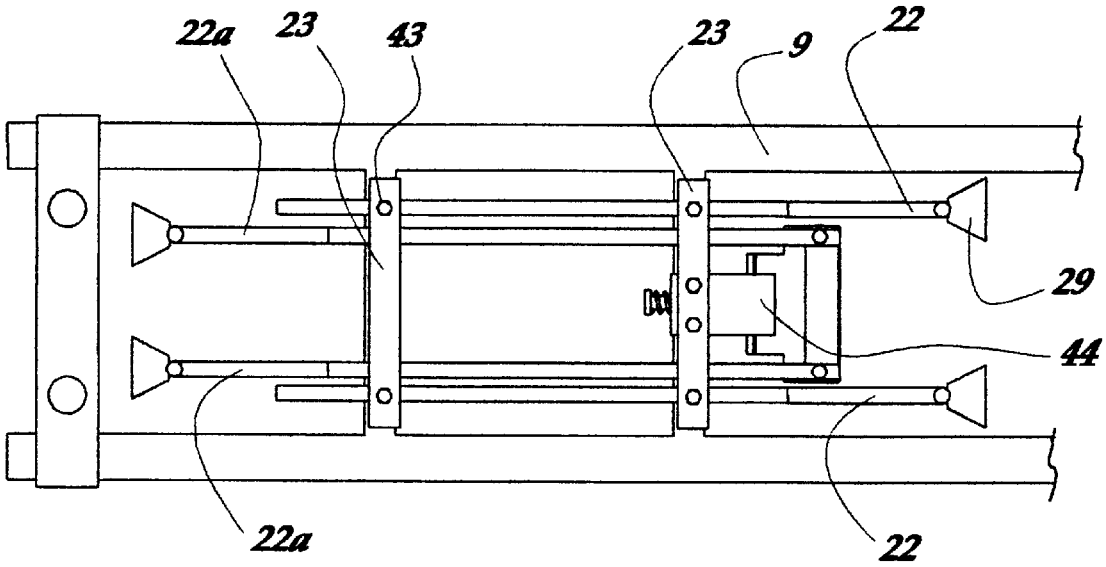
FIG. 6 is a bottom view of FIG. 5.

As shown in FIGS. 5 and 6 one set of the tubular braces, e.g. 22, may be adjustably fastened, as by screws 43, to the lower transverse plate 23, positioned to fit against the inner side 41 of the outer bathtub wall 10. The other set of tubular braces 22*a* may be slidable positioned to bear against the opposite wall 42 of the bathtub. An adjustable, draw latch 44 anchored on a transverse plate 23 may be used to resiliently thrust the tubular braces 22*a* into position.

Because the ends of the tubular braces 22, 22*a* are curved, the height at which end-mounted resilient pads or rubber feet 29, bear against the tub walls 41, 42 may be adjusted by rotating the tubes 22, 22*a*.

In FIGS. 7 and 8 the caster 5 has a wheel 46 and a rotatable block 47 that may be thrust into the wheel 46 by drawing upwardly on the rod 31 and thereby braking the wheel. As shown in FIG. 8 the block 47 is carried on a shaft 48 with a cranked end 49 connected to the rod 31.

By reason of the simplicity of the invention, the assembly is light weight and may be readily removed and easy reinstallation. These conveniences, its low cost and its ease of use provide this invention with advantages which will prove attractive to care-givers and patients alike.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A bathtub invalid seat assembly including a seat mounted to advance, upon installation, from a position at the outer side of a bathtub proximate to a floor that is outside the bathtub, to an inner location wherein the seat will be positioned over the center region of said bathtub whereat a person may be washed or showered comprising:

(1) two rails dimensioned to span the width of said bathtub from an inner to outer side of the bathtub, such rails being provided on the inner bathtub side with inner rail-support means, and provided on the outer bathtub side with outer rail-support means for supporting the rails above the bathtub;

(2) two supporting bars for carrying the seat, such bars having inner and outer ends and being connected to:

(a) two moveable seat-support legs by which the bars may be held off the floor on the side of the seat remote from the bathtub;

(b) supporting bearings fitted to the supporting bars proximate to the inner ends of said support bars, said bearings being shaped and positioned to engage with the two rails whereby the seat supporting bars and seat-support legs may all be advanced together along the rails, to thereby shift the seat from a position at the outer side of said bathtub to a position over the center region of the bathtub with said seat-support legs also shifted to a position adjacent to the outer side of said bathtub.

2. An assembly as in claim 1 wherein the supporting bearings are rollers located to provide an axis of rotation for the supporting bars substantially at the inner ends of said bars permitting the outer ends of such bars to be elevated by hand for advancement of the supporting bars for the seat and seat support legs.

3. An assembly as in claim 2 wherein one or more of the wheels are provided with brake means.

4. An assembly as in claim 3 comprising a positioning brace means which extends downwardly from the rails to engage with the inside surface of a bathtub and secure the rails against being displaced during use.

5. An assembly as in claim 4 wherein said positioning brace means comprises tubular braces that are mounted for sliding advancement across the width of a bathtub having inner walls to engage with the inner walls of such bathtub.

6. An assembly as in claim 2 comprising a positioning brace means which extends downwardly from the rails to engage with the inside surface of a bathtub and secure the rails against being displaced during use.

7. An assembly as in claim 6 wherein said positioning brace means comprises tubular braces that are mounted for sliding advancement across the width of a bathtub having inner walls to engage with the inner walls of such bathtub.

8. An assembly as in claim 1 wherein the moveable seat-support legs are provided with wheels at their lower ends.

9. An assembly as in claim 8 comprising a linkage extending upwardly from the brake means whereby the brake means may be actuated by the person seated on the seat.

10. An assembly as in claim 9 comprising a positioning brace means which extends downwardly from the rails to engage with the inside surface of a bathtub and secure the rails against being displaced during use.

11. An assembly as in claim 10 wherein said positioning brace means comprises tubular braces that are mounted for sliding advancement across the width of a bathtub having inner walls to engage with the inner walls of such bathtub.

12. An assembly as in claim 8 comprising a positioning brace means which extends downwardly from the rails to engage with the inside surface of a bathtub and secure the rails against being displaced during use.

13. An assembly as in claim 12 wherein said positioning brace means comprises tubular braces that are mounted for sliding advancement across the width of a bathtub having inner walls to engage with the inner walls of such bathtub.

14. An assembly as in claim 1 wherein said outer rail support means comprises legs which extend downwardly from said rails to said floor.

15. An assembly as in claim 14 comprising a positioning brace means which extends downwardly from the rails to engage with the inside surface of a bathtub and secure the rails against being displaced during use.

16. An assembly as in claim 15 wherein said positioning brace means comprises tubular braces that are mounted for sliding advancement across the width of a bathtub having inner walls to engage with the inner walls of such bathtub.

17. An assembly as in claim 1 in combination with a tub that has an inner sidewall that provides a ledge wherein the inner rail-support means comprises tub ledge contacting extension means for extending to the ledge whereby the rails may be supported by said ledge.

18. An assembly as in claim 17 wherein the inner rail-support means comprises adjustable spacers that extend downwardly to rest on the ledge.

19. An assembly as in claim 1 comprising a positioning brace means which extends downwardly from the rails to engage with the inside surface of a bathtub and secure the rails against being displaced during use.

20. An assembly as in claim 19 wherein said positioning brace means comprises tubular braces that are mounted for sliding advancement across the width of a bathtub having inner walls to engage with the inner walls of such bathtub.

* * * * *